United States Patent [19]

Goodnow et al.

[11] Patent Number: 4,691,406

[45] Date of Patent: Sep. 8, 1987

[54] DOCTORING APPARATUS

[75] Inventors: Ronald F. Goodnow, Leicester; Robert A. Reid, Charlton City, both of Mass.

[73] Assignee: Thermo Electron-Web Systems, Inc., Auburn, Mass.

[21] Appl. No.: 902,515

[22] Filed: Sep. 2, 1986

[51] Int. Cl.[4] ..... B08B 1/02

[52] U.S. Cl. ..... 15/256.53; 100/174; 162/281

[58] Field of Search ..... 15/256.5, 256.51, 256.53; 162/281; 100/174; 101/425, 157, 169

[56] References Cited

U.S. PATENT DOCUMENTS 2,664,792 1/1954 Cook ..... 15/256.53
3,847,480 11/1974 Fisher ..... 15/256.53 X
4,528,067 7/1985 Hedberg ..... 162/281

FOREIGN PATENT DOCUMENTS 2474899 8/1981 France ..... 15/256.53

*Primary Examiner*—Chris K. Moore
*Attorney, Agent, or Firm*—Maurice E. Gauthier

[57] ABSTRACT

A doctoring apparatus employs a doctor blade having a length greater than the face length of the surface being doctored. A blade holder applies an intermediate portion of the blade to the doctored surface. The blade is movable longitudinally through the blade holder, and has continuing portions extending beyond the ends of the holder. At least one clamp acts on one of the continuing blade portions. The clamp is adjustable between a closed setting preventing relative movement between it and the blade, and the open setting permitting such relative movement. A drive reciprocates either the blade holder or the clamp in one direction when the clamp is closed and in the opposite direction when the clamp is opened, thereby causing the blade to move incrementally in one direction across the surface being doctored.

10 Claims, 9 Drawing Figures

DOCTORING APPARATUS

BACKGROUND OF THE INVENTION

This invention relates to a doctoring apparatus of the type employing an elongated flexible coiled blade, and is concerned in particular with an improved mechanism for traversing the blade material across the surface being doctored.

In the traditional doctoring apparatus, the blade is normally of a length approximately equal to the face length of the surface being doctored, for example the cylindrical surface of a rotating cylinder. In order to more evenly distribute wear of the cylinder surface and blade working edge, the blade support structure is often arranged to reciprocate to and fro through a relatively short stroke of approximately one inch or less. Eventually, however, when the blade becomes worn, it must be removed and replaced with a fresh blade. This unavoidably results in an interruption of the production process, which in turn increases product costs while at the same time adversely affecting product quality.

In recent years, attempts have been made at reducing lost production time occasioned by the need to make blade changes. These attempts have focused on feeding coiled blade stock across the width of the surface being doctored. A typical example of this approach is described in U.S. Pat. No. 4,528,067. Experience has indicated, however, that such arrangements have serious limitations because of high induced stress levels in the blade material and also because of the high torque levels required to drive the take up reels.

For example, during a normal doctoring operation, depending on the length of the blade in contact with the surface being doctored and the force with which the blade is being applied to that surface, the forces required to pull the blade through the blade holder can range between 2000–6000 pounds. Factors such as contaminants in the blade groove and high friction along the blade working edge can neccessitate even higher blade pulling forces.

In addition to the tension stresses produced by these pulling forces, the blade material also experiences bending stresses as the blade stock is wound onto the take up reels. Thus, where a drive reel is used to pull the blade stock through the holder, the combination of tensile, bending and radial stresses acting on the blade cross section can exceed the yield strength of the blade material, thereby causing breakage.

It has been recognized that the above noted bending stresses are inversely proportional to the radius of curvature that the blade stock is forced to take as it is wound onto the drive reel. For example, with a 0.050" thick blade being pulled through the holder with a 3000 pound force, a radius of curvature at the reel of 6–¼" produces a bending stress of approximately 150,000 p.s.i., and necessitates a reel driving torque of 18,750 lb.-in. If the radius of curvature at the reel is increased to 15", bending stresses are beneficially reduced to approximately 63,000 p.s.i., but the reel driving torque is increased dramatically to 45,000 lb.-in. These high driving torques in turn necessitate large and expensive drive mechanisms.

Thus, it will be seen that with conventional arrangements employing driven reels to pull the blade stock through the holder, small diameters result in unacceptably high bending stresses with relatively low driving torques. Conversely, large diameters lower the bending stresses to acceptable levels, but the driving torques are boosted to levels which require unacceptably large and expensive drives.

A basic objective of the present invention is to provide an improved mechanism for longitudinally moving the blade stock across the surface being doctored, without generating high bending stresses, and without having to employ large and expensive drive mechanisms.

SUMMARY OF THE INVENTION

In the several embodiments of the invention to be described hereinafter in greater detail, at least one clamp is arranged to act on the blade at a location between one end of the blade holder and the adjacent reel receiving the blade stock. The clamp is adjustable between a closed setting preventing relative movement between it and the blade and an open setting permitting such movement. A drive is employed to reciprocate either the blade holder or the clamp in one direction when the clamp is open and in the opposite direction when the clamp is closed, thereby causing the blade to move incrementally in one direction through the blade holder and across the surface to be doctored.

DETAILED DESCRIPTION OF ILLUSTRATED EMBODIMENTS

Figure 1:
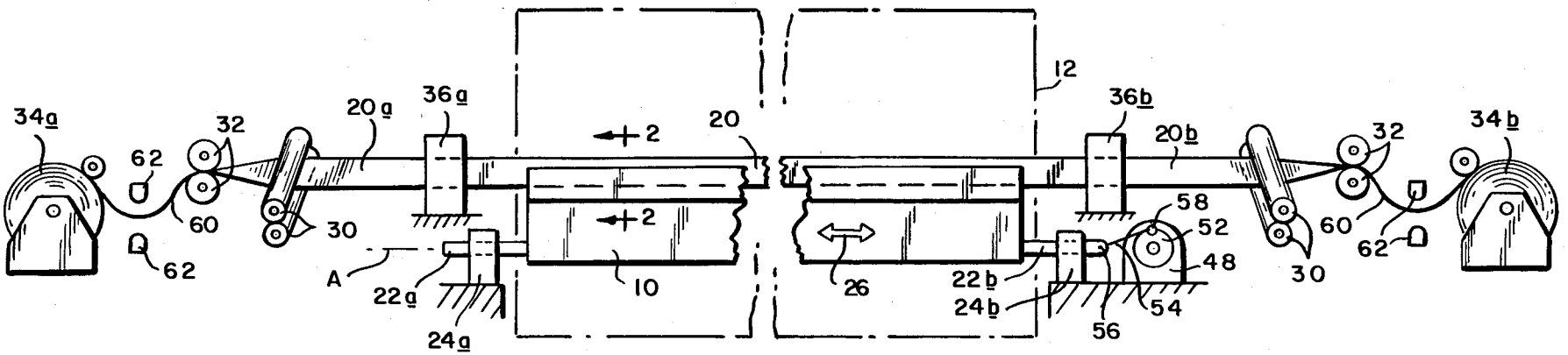
FIG. 1 is a schematic illustration of a doctoring arrangement in accordance with one embodiment of the invention.
Figure 2:
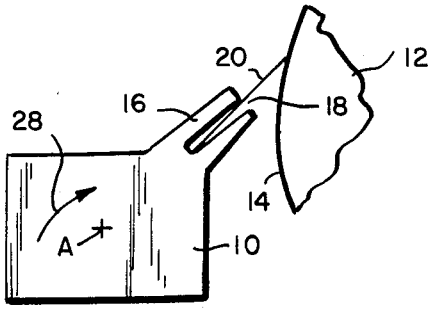
FIg. 2 is a view in cross section taken along line 2—2 of FIG. 1.

Referring initially to FIGS. 1 and 2, a doctor blade holder 10 is shown positioned adjacent to a rotating cylinder 12 having a surface 14 to be doctored. The holder includes a jaw 16 forming a slot 18 with an open end facing the cylinder surface 14. The slot 18 is suitably configured and dimensioned to receive a doctor blade 20. The holder has stub shafts **22*a*, 22*b* protruding axially from opposite ends thereof. The stub shafts are received in bearings 24*a*, 24*b* which permit the holder to reciprocate in opposite directions as indicated diagrammatically at 26, and also to pivot about axis "A". A cylinder or other like means (not shown) acts either on the holder or on one of the stub shafts to pivot the holder in the direction indicated as 28 in FIG. 2, thereby urging the working edge of the doctor blade 20 against the roll surface 14**.

The doctor blade 20 has a length which is considerably greater than the axial length of the cylinder 12. Thus, the holder 10 applies an intermediate portion of the blade to the cylinder surface 14, and continuing portions **20*a*, 20*b* of the blade extend beyond the ends of the blade holder. The continuing blade portions 20*a***, 20*b* pass respectively through pairs of guide rollers 30, 32, and are coiled on reels 34*a*,34*b*.

Figure 3:
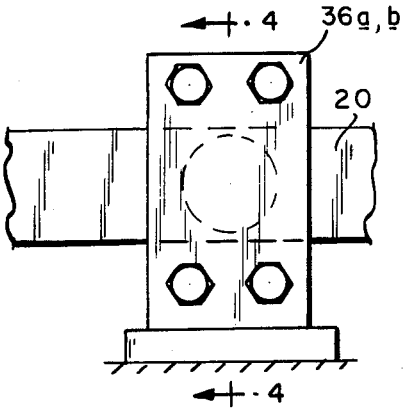
FIG. 3 is an elevational view on an enlarged scale of one of the clamp mechanisms shown in FIG. 1.
Figure 4:
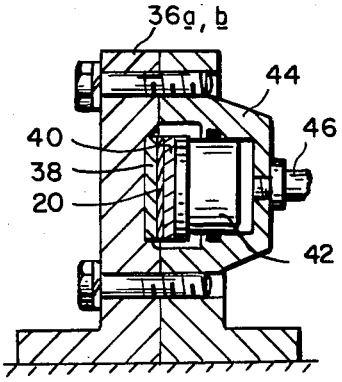
FIG. 4 is a sectional view taken along line 4—4 of FIG. 3.

A first clamp mechanism 36*a* is arranged to act on the continuing blade portion 20*a* at a location between one end of the blade holder 10 and the reel 34*a*, and a second identical clamp mechanism 36*b* is similarly located between the other end of the blade holder and the reel 34*b*. As is best shown in FIGS. 3 and 4, each of the clamp mechanisms 36 includes a fixed brake pad 38 arranged to frictionally contact one side of the doctor blade 20, and a movable brake pad 40 carried on a piston 42 and arranged to frictionally contact the opposite side of the blade. The piston 42 is enclosed within a cylinder head 44 connected by means of a conduit 46 to a source of pressurized fluid (not shown), e.g., hydraulic oil. As illustrated in FIG. 4, the clamp mechanism is adjusted to the closed setting at which the piston 42 is loaded and the blade is frictionally held between the brake pads 38, 40 with a clamping force sufficient to prevent relative movement between the blade and clamp mechanism. When the fluid pressure on the piston 42 is relieved, the clamp mechanism is adjusted to the open setting at which the blade is free to move longitudinally between the brake pads 38, 40.

A drive 48 has a rotating output disc 52. A link 54 is pivotally connected at one end as at 56 to the adjacent stub shaft 22*b*, and at the opposite end as at 58 to the disc 52 at a location offset laterally from its rotational axis. Thus, the drive 48 has a rotary stroke which imparts a reciprocating stroke to the blade holder 10.

The clamping force exerted by each of the clamp mechanisms 36*a*,36*b* is sufficient to overcome the frictional forces tending to resist movement of the blade 20 through the holder 10. However, with both clamp mechanisms open, the frictional forces acting between the blade and holder are sufficient to resist relative movement therebetween, thus causing the blade to move with the holder in the direction in which the holder is being reciprocated by the drive 48. Thus, and with reference to the following TABLE A, it will be seen that the blade 20 can be moved incrementally through the blade holder 10 and across the cylinder surface 14 in the "left" direction as viewed in FIG. 1 by leaving clamp mechanism 36*b* open and by closing clamp mechanism 36*a* only when the blade holder is moving in the "right" direction.

TABLE A

| BLADE DIRECTION | BLADE HOLDER DIRECTION | CLAMP 36a | CLAMP 36b |
|---|---|---|---|
| INCREMENTAL LEFT | R | C | O |
| | L | O | O |
| | R | C | O |
| | L | O | O |
| INCREMENTAL RIGHT | R | O | O |
| | L | O | C |
| | R | O | O |
| | L | O | C |

R = Right
L = Left
O = Open
C = Closed

By the same token and again with reference to TABLE A, the blade can be moved incrementally in the right direction by leaving the clamp mechanism 36*a* open, and by closing the clamp mechanism 36*b* only when the blade holder is moving in the left direction.

This arrangement offers a number of significant advantages over known prior art arrangements which pull the blade through the holder by driving one of the reels 34*a*, 34*b*. To begin with, as evidenced by the loops 60, the tension force required to pull the blade through the holder is largely independent from any bending stresses that are induced in the blade as it is coiled onto the reels. Thus, and in comparison with conventional "reel-type" pulling mechanisms, overall blade stress is minimal and there is much less chance of blade breakage. Also, since the blade is not under high tension at locations outboard of the clamp mechanisms 36*a*, 36*b*, it is possible to convey the blade through long distances without endangering operating personnel. Thus, the reels 34*a*,34*b* can be located remotely from the opposite ends of the cylinder 10.

Loop sensors 62 can be employed to control the reel drives and thereby insure that the blade stock is being properly paid off and taken up.

Only limited power is required to reciprocate the blade holder 10. Thus, both the size and cost of the drive 48 are minimized as compared with the reel drives of the prior art arrangements.

Still another advantage of the present invention stems from the fact that the blade is moved across the surface being doctored at a constant rate which is dependent only on the rotational speed and stroke of the drive 48. This is to be contrasted to the prior art arrangements, where the speed of the reel drives must be continuously adjusted in order to compensate for the changes in size of the coils being taken up and paid off.

Figure 5:
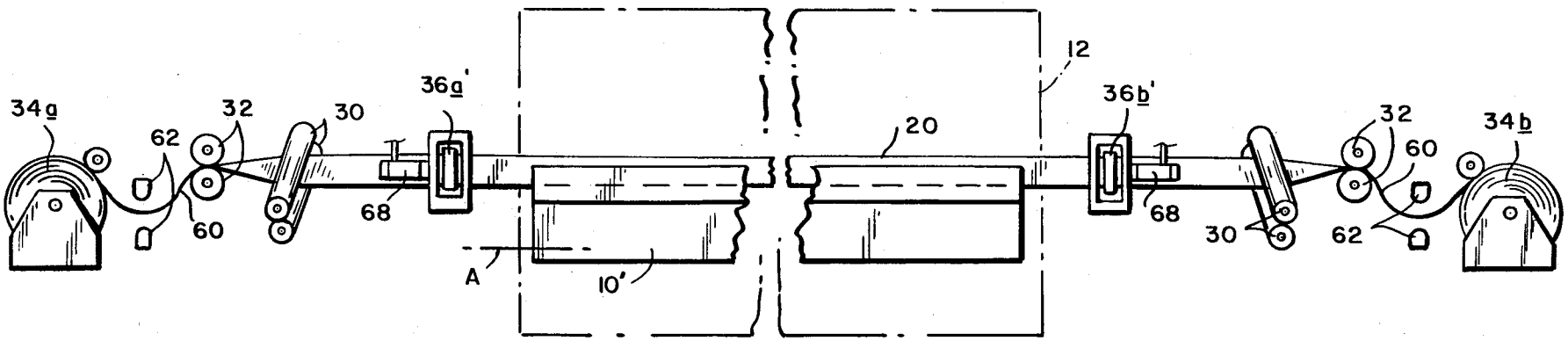
FIG. 5 is a view similar to FIG. 1 showing an alternate embodiment of the invention.
Figure 6:
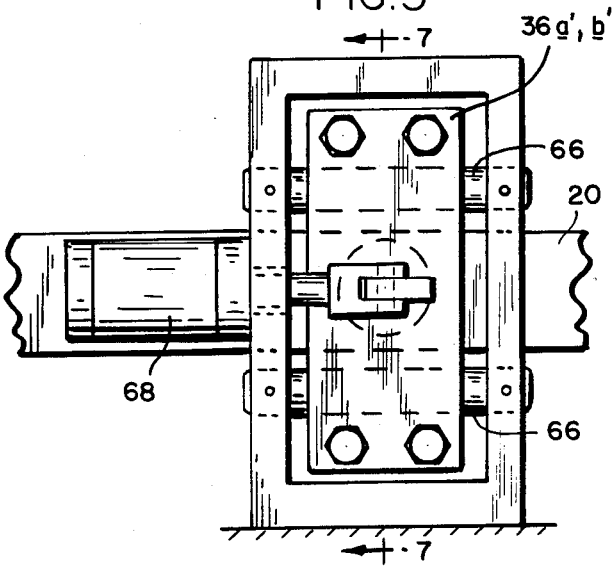
FIG. 6 is an elevational view on an enlarged scale of one of the clamp mechanisms shown in FIG. 5.
Figure 7:
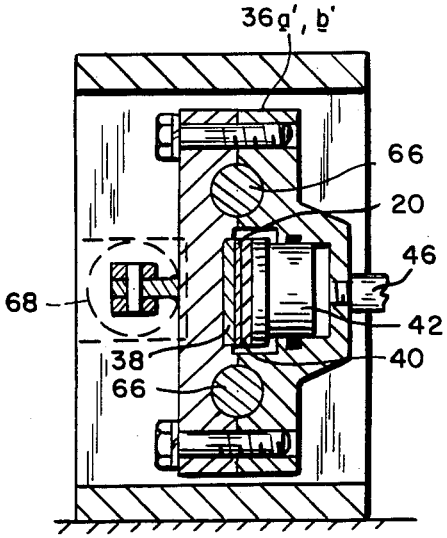
FIG. 7 is a sectional view taken along line 7—7 of FIG. 6.

With reference now to FIGS. 5–7, an alternate embodiment of the invention is shown, with the same reference numerals having been employed to designate those components which are identical to those of the previously described embodiment. Here, the blade holder 10' is of the non-reciprocating type. The clamp mechanisms 36*a*',36*b*' are slidably mounted on parallel guide pins 66, and are reciprocated by means of piston-cylinder units 68.

With this arrangement, if the blade is to be moved incrementally to the left as viewed in FIG. 5, the clamp mechanism 36*b*' is kept open and stationary. The clamp mechanism 36*a*' is closed when being stroked to the left and is opened when being stroked to the right. Blade movement in the opposite or right direction is achieved by keeping clamp mechanism 36*a*' open and stationary, and by closing clamp mechanism 36*b*' only when it is being sroked to the right.

Figure 8:
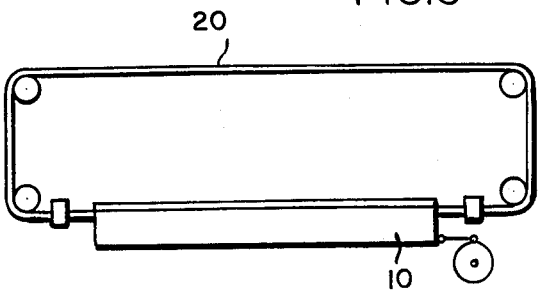
FIGS. 8 and 9 are schematic illustrations of other alternate embodiments of the invention.
Figure 9:
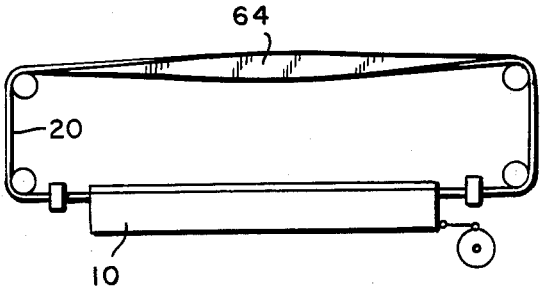

FIGS. 8 and 9 illustrate other possibilities where the blade constitutes an endless band guided around a plurality of idler rolls. In FIG. 9, the blade is in the form of a "Mobius" strip, with a twist as at 64 which causes opposite edges of the blade to be alternately applied to the doctored surface with each pass.

In light of the foregoing, it will be appreciated by those skilled in the art that numerous modifications can be made to the embodiments herein described without departing from the spirit and scope of the invention. For example, and with reference to FIG. 1, means other than the crank drive mechanism 48 can be employed to reciprocate the blade holder 10. Such other drives might include single or double acting piston-cylinder units or bladder-type actuators.

Where it is only desirable to move the blade stock in one direction, only a single clamp mechanism is required. Also, various types of conventional reel mechanisms and reel drives can be employed to take up and pay off the blade stock.

We claim:

1. Apparatus for doctoring the surface of a rotating cylinder, comprising:

a doctor blade having a length greater than the axial length of the cylinder;

blade holding means for applying an intermediate portion of said doctor blade to the surface of the cylinder, said blade being longitudinally movable through said holding means and having continuing portions extending beyond the ends of said blade holding means;

clamping means for acting on at least one of the continuing portions of said blade, said clamping means being adjustable between a closed setting preventing relative movement between said blade and said clamping means, and an open setting permitting said relative movement; and a drive for reciprocating one of said means in one direction when said clamping means is closed and in the opposite direction when said clamping means is open, thereby causing said blade to move incrementally in one direction across the surface of the cylinder.

2. The apparatus of claim 1 wherein said drive is arranged to reciprocate said blade holding means, and wherein said clamping means is fixed with respect to the direction of blade movement.

3. The apparatus of claim 1 wherein said drive is arranged to reciprocate said clamping means, and wherein said blade holding means is fixed with respect to the direction of blade movement.

4. The apparatus of claim 1 wherein a first clamping means is arranged to act on one of the continuing portions of said blade, and a second clamping means is arranged to act on the other continuing portion of said blade, said first and second clamping means being alternatively usable in conjunction with said drive for causing said blade to move incrementally in either of two directions across the surface of said cylinder.

5. The apparatus of claim 1 wherein said blade constitutes an elongated flexible band, and wherein reeling means are provided at opposite ends of said cylinder for storing said continuing blade portions in coil form, one of said reeling means being operative to pay off its respective continuing blade portion and the other of said reeling means being operative to take up its respective continuing blade portion.

6. The apparatus of claim 5 wherein said clamping means is arranged between said blade holding means and one of said reeling means.

7. The apparatus of claim 1 wherein said drive comprises a rotatably driven element, and linkage means pivotally connected to both said element and said means.

8. The apparatus of claim 1 wherein said blade constitutes an elongated flexible band, and wherein said continuing portions are interconnected.

9. The apparatus of claim 1 wherein said blade constitutes a flexible Mobius strip having first and second working edges which are alternately applied to the surface of said cylinder.

10. Apparatus for doctoring the surface of a rotating cylinder, comprising:

an elongated flexible doctor blade having a length greater than the axial length of the cylinder;

blade holding means for applying an intermediate portion of said doctor blade to the surface of the cylinder, said blade being longitudinaly movable through said holding means and having continuing portions extending beyond the ends of said blade holding means, the longitudinal movement of said blade in relation to said blade holding means being resisted by frictional forces during application of said blade to the surface of the cylinder;

reeling means at opposite ends of said cylinder for receiving and storing said continuing blade portions in coil form, one of said reeling means being operative during longitudinal movement of said blade through said holding means to pay off its respective continuing blade portion and the other reeling means being simultaneously operative to take up its respective continuing blade portion;

clamping means arranged to act on at least one of the continuing blade portions at a location between said blade holding means and at least one of said reeling means, said clamping means being adjustable between a closed setting preventing relative movement between said blade and said clamping means, and an open setting permitting said relative movement; and a drive for reciprocating one of said means in one direction when said clamping means is closed and in the opposite direction when said clamping means is open, the closure of said clamping means being effective to overcome the frictional forces resisting longitudinal movement of said blade in relation to said blade holding means, thereby causing said blade to move incrementally across the surface of the cylinder.

* * * * *